United States Patent [19]

Holmes

[11] 4,326,478

[45] Apr. 27, 1982

[54] WATER-REMOVING SYSTEM FOR A CATAMARAN BOAT

[76] Inventor: David A. Holmes, 811 Wright Ave., Chesapeake, Va. 23324

[21] Appl. No.: 163,670

[22] Filed: Jun. 27, 1980

[51] Int. Cl.[3] ..... B63B 13/00

[52] U.S. Cl. ..... 114/183 R; 114/90

[58] Field of Search ..... 114/183 R, 333, 125, 114/61, 90

[56] References Cited

U.S. PATENT DOCUMENTS

| | | | |
|---|---|---|---|
| 1,488,067 | 3/1924 | Schneider | 114/125 X |
| 2,536,475 | 1/1951 | Thomas | 114/183 R X |
| 2,664,241 | 12/1953 | Sunday | 114/183 R X |
| 3,430,595 | 3/1969 | Tulleners | 114/61 |
| 4,136,414 | 1/1979 | Popkin | 114/61 X |
| 4,159,692 | 7/1979 | Dye | 114/333 |
| 4,176,614 | 12/1979 | Goss | 114/125 |

*Primary Examiner*—Trygve M. Blix
*Assistant Examiner*—John C. Paul

[57] ABSTRACT

A catamaran boat having hollow mast and hulls is provided with a system comprising a manually operable pneumatic pump and flexible conduits communicating between the pump and the interiors of the hollow mast and hulls, whereby the interiors can be pressurized to drive water therefrom through an ejection device provided with check valves. The removal of water not only lightens the weight of the boat for securement of greater speed, but enables the boat to be righted if capsized in a turtle position.

6 Claims, 5 Drawing Figures

WATER-REMOVING SYSTEM FOR A CATAMARAN BOAT

BACKGROUND OF THE INVENTION

This invention relates to an improvement in a catamaran boat comprised of a mast and twin hulls, and is more particularly concerned with an improved system for removing water from the interiors of said mast and hulls.

Lightweight catamaran boats comprised of twin hulls with a deck structure therebetween, a mast and sailcloth associated therewith, enjoy widespread popularity for leisurely sailing and racing. Said hulls and mast are generally fabricated from thin, rigid structural materials as hollow structures which minimize the weight and improve the buoyancy of the boat. When newly manufactured, the hulls and mast are impervious to water. However, prolonged use, ageing, and exposure to weathering factors of sunlight, heat and moisture may cause the development of fissures in the structural material which permit entrance of water. Cognizant of such eventual leakage, most hulls of catamarans are provided with a drainage port located adjacent their lower extremities.

In the course of racing a catamaran boat, even small amounts of water entrapped within the hulls will have a significant adverse affect on the speed atainable by the boat. Unequal amounts of water within the two hulls may also exert a destabilizing effect on the boat. Although it is desirable to remove said entrapped water, the use of a conventional water pump is not feasible because the pump must draw from a substantially sealed structure, and the vacuum thereby generated will not only impair pumping efficiency but may also induce rapid entrance of water into the hull through said fissures. Furthermore, the use of an electrically powered pump would add considerable weight to the boat in view of the weight of the pump and its power source. If some manner of hand-operated device for removing water were to be separately associated with each hull, movement of a crewman to said separate hulls would be required, thereby causing an undesirable shifting of weight in the boat.

Small catamarans, having hull lengths of about 14 to 16 feet, capsize frequently, especially when driven to the brink of their performance characteristics during a race. If the hollow mast is filled with air, its buoyant effect will cause the catamaran to assume a sideways position with one hull above water. From this position, it is reasonably easy for the crewman to return the boat to its upright position. However, if the mast rapidly fills with water and thereby provides no buoyancy, the mast will assume a downwardly pointed orientation, causing the two hulls to float at equal levels relative to the surface of the body of water. From said latter position, generally referred to as the "turtle" position, it is substantially impossible for the crewman to turn the boat back to its normally erect position.

It is accordingly an object of the present invention to provide an improved system for removing water from the hollow interiors of the mast and twin hulls of a catamaran boat.

It is another object to provide a system of the aforesaid nature capable of manual operation.

It is a further object of this invention to provide a system of the aforesaid nature which does not require that a crewman shift his position within said boat to remove water from either hull.

It is still another object of the invention to provide a system of the aforesaid nature which will enable a crewman to right a capsized catamaran from a turtle position.

These objects and other objects and advantages of the invention will be apparent from the following description.

SUMMARY OF THE INVENTION

The above and other beneficial objects and advantages are accomplished in accordance with the present invention by the provision of a system comprising a manually operated pump adapted to generate a pneumatic pressure, conduits communicating between said pump and the hollow mast and hollow twin hulls of a catamaran boat, each of said hollow members being provided with ejection means whereby internally confined water may be forced out of said hollow member by the driving force of said pneumatic pressure, said ejection means having associated therewith a check valve which prevents entrance of water into said hollow member.

In a preferred embodiment of the invention, the distal ends of said conduits, namely the ends furthest from said pump engage said hollow members by an easily disconnectable coupling. The site of emergence of the ejection means associated with said hulls is preferably above the waterline. The site of emergence of the ejection means associated with said mast is preferably adjacent the uppermost portion of said mast, namely that portion of said mast most distantly located from said hulls.

BRIEF DESCRIPTION OF THE DRAWINGS

For a fuller understanding of the nature and objects of the invention, referral should be had to the following detailed description taken in conjunction with the accompanying drawings forming a part of this specification and in which similar numerals of reference indicate corresponding parts in all the figures of the drawings.

DESCRIPTION OF THE PREFERRED EMBODIMENTS

Figure 1:
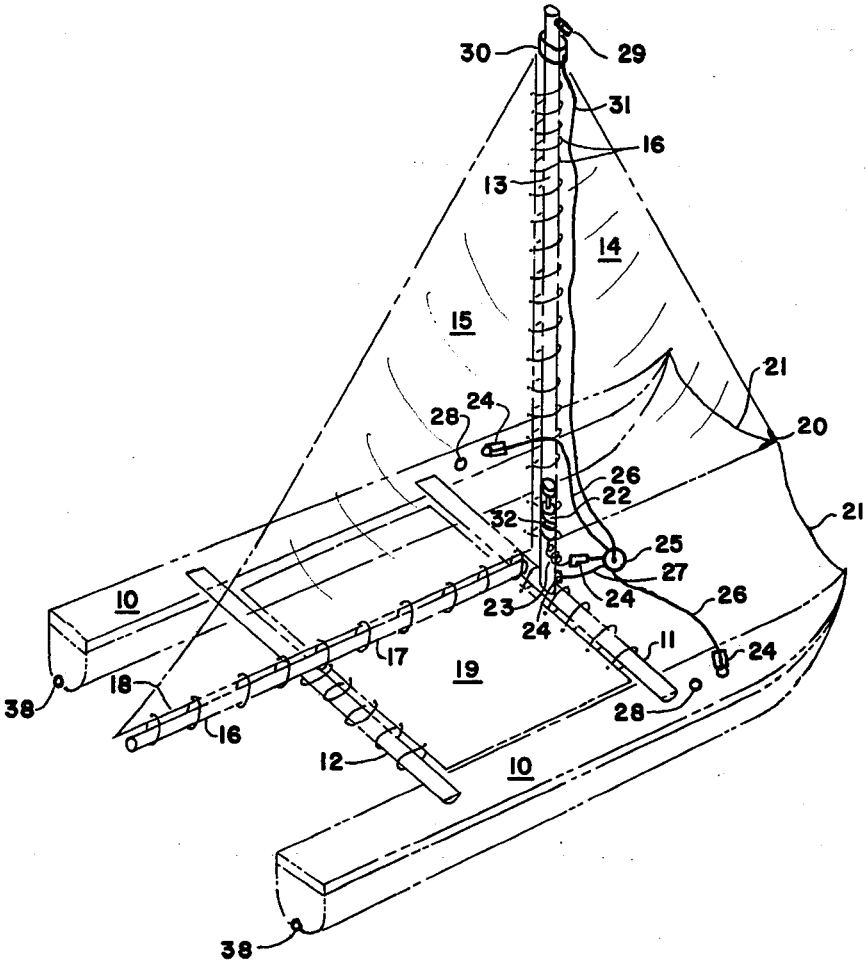
FIG. 1 is a schemtic illustration of an embodiment of the water-removing system of the present invention in association with a catamaran boat shown in phantom outline.
Figure 2:
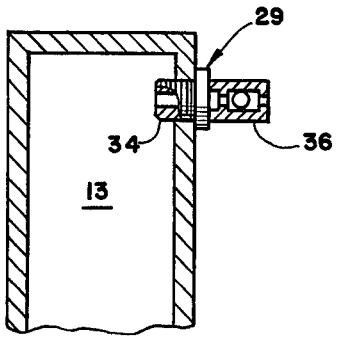
FIG. 2 is an enlarged fragmentary vertical sectional view of the top of the mast of FIG. 1.

Referring to FIG. 1, a catamaran sail boat is shown comprised of substantially identical hulls 10 held in spaced parallel juxtaposition by front cross beam 11 and parallel rear cross beam 12. A mast 13 rises vertically from attachment at the center of front cross beam 11, said attached extremity of said mast being considered the base thereof, the opposite extremity being considered the top. Front sailcloth 14 and rear sailcloth 15 are attached to said mast by a lacing cord 16. A straight rigid boom 17 laced to the bottom edge 18 of said front sailcloth maintains said sailcloth taught and maneuverable. A canvas deck platform 19 is attached by lacing cord 16 to said front and rear cross beams. The leading lower corner 20 of front sailcloth 14 is tied to said hulls by control lines 21. Drain cocks 38 are positioned in the rear surfaces of said hulls adjacent their lower most extremities. Other conventional features of a sail boat may be present, although not shown in FIG. 1, said features including: a rudder associated with the rear end of said hulls, means for positioning boom 17, and means for hoisting and lowering said sailcloths.

The water removing system of the embodiment of FIG. 1 is comprised of a manually operable pneumatic pump 22, a flexible output line 23 emanating therefrom, a quick-release connector means 24 attached to the end of said output line, a selector valve 25 in downstream communication with said connector, flexible conduits 26 and 27 leading to said hulls and mast respectively, the proximal ends of said conduits emanating from said valve and the distal ends of said conduits terminating in quick-release connectors 24 which facilitate attachment to and communication with said mast and hulls, and ejector means 28 and 29, positioned in said hulls and mast respectively.

In an optional embodiment of the water-removing system of this invention, a flotation device in the form of an air-tight bag 30 or equivalent structure may be positioned adjacent the top of said mast and in communication with pump 22 via conduit 31 emanating from valve 25.

Figure 4:
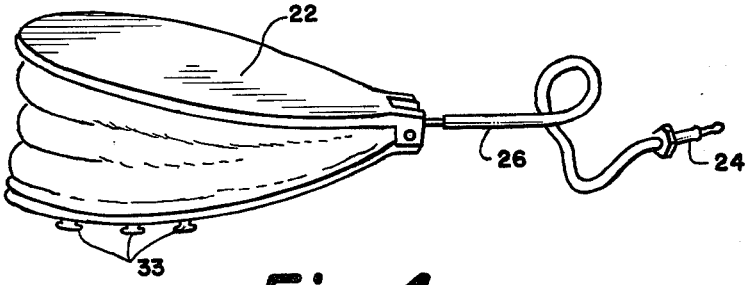
FIG. 4 is a perspective view of an embodiment of manually operated pump useful in the water-removing system illustrated in FIG. 1.

The pump may be of piston-type design or of bellows-type design, as shown in FIG. 4, or of other equivalent design. The pump is preferable provided with attachment means having quick-release capability and which may have the form of a snap-away band 32 as shown in FIG. 1. Other embodiments of attachment means, such as suction cups 33 shown in FIG. 4, or snap-fasteners, or Velcro binding material, and equivalents thereof facilitate mounting of the pump at various parts of the boat and permit operation of the pump while attached to the boat. Such manner of attachment obviates the need of the crewman to hold the pump while it is being stroked. The pump may be attached to a lowermost portion of the mast, or to a hull, or to other readily accessable locations which would not interfere with the normal operation of the boat. The pump may be designed for hand or foot operation and should be capable of generating a pressure of at least 10 pounds per square inch, and should be designed to deliver at least 100 cc of air per stroke with a stroke length less than about 10 inches. The pump may be fabricated of metals, plastics or other substances resistant to corrosion in a salt water environment.

The output line 23 and flexible conduits 26 and 27 have an inside diameter of about ⅛" and may be fabricated of plastics such as polyethylene and polyvinylchloride. Attachment of the distal and proximal ends of said conduits to their appropriate cooperating components is achieved by disconnectable couplings such as standard tube fittings which, by threaded means, achieve frictional retention of the ends of said tubes. Output line 23 may be a coiled flexible tube having sufficient extensibility to facilitate proper functioning of the water-removing system regardless of the relative placement between said pump and the several flexible conduits. Selector valve 25 may be mounted on said pump or separated therefrom and may be comprised of a standard rotary multi-port valve or equivalent thereof.

The disconnectable couplings may be threaded fittings of metal or plastic, or may be insertively interactive quick-release connectors, preferably of the double end shut-off type wherein both of the disconnected members become sealed when disconnection is effected. Still other equivalent types of releasible connectors may be utilized. Suitable specific couplings include Swagelok QC 4D-200 manufactured by the Crawford Fitting Company of Niagra Falls, Ontario. Such Swagelok couplings, of the quick-release double end shut-off type, may be fabricated of 316 stainless steel or other corrosion-resistant materials, and permit rapid coupling of components merely by a single insertive motion. Because of the removeable mounting of the pump and the readily disconnectible nature of the flexible conduits, the entire water-removing system may be readily installed onto or removed from the catamaran.

Figure 3:
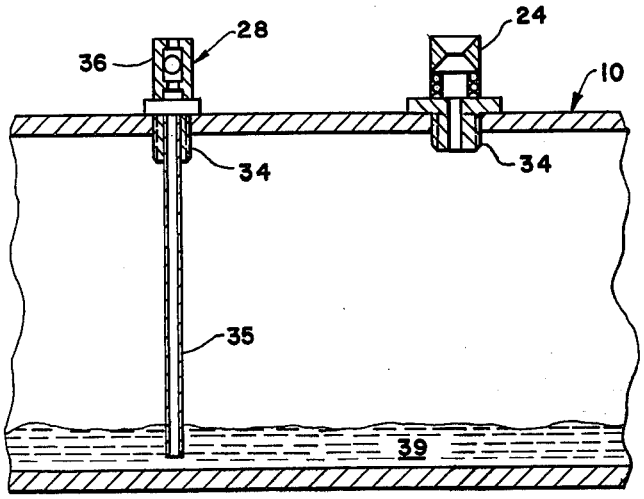
FIG. 3 is an enlarged fragmentary vertical sectional view of a hull of FIG. 1.
Figure 5:
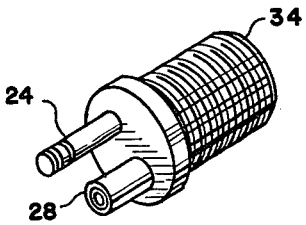
FIG. 5 is a perspective view of an embodiment of combined conduit coupling and ejection means.

The distal ends of flexible conduits 26 may communicate with portions of said hulls above the waterline, as shown in FIG. 3 by the location of connector 24 and threaded fastener 34 associated therewith. The ejector means 28 associated with said hulls may likewise be located in an uppermost portion of said hulls. As shown in FIG. 3, said ejector means is comprised of a vertically disposed extension tube 35, the lowermost end of which closely approaches the bottom of the interior of said hull where it may be immersed in water 39 collected within said hull. A check-valve 36 is positioned atop threaded fastener 34. The function of said check valve is to permit water to exit the hull while preventing entrance of water into the hull. Said check valve may utilize a moveable ball, a flapper valve, spring-loaded closures, or equivalent constructions well known in the art. The connectors for the distal ends of the conduits may be combined with the ejector means as a united structure, as shown in FIG. 5. Said combined structure requires only one hole in the hull, and in fact said combined structure may replace drain cock 38, thereby obviating the need to bore any additional holes in the hull.

The mast is provided with ejector means 29 and associated check valve 36 adjacent its top, and air admitting connector means 24 adjacent its base.

In operation, when it is thought that water has entered either hull during the sailing of the catamaran, selector valve 25 is turned to provide a communicating pathway to said hull. The pump is then stroked to generate a pressure within said hull. Said pressure drives water within the hull upwardly within extension tube 35 and through check valve 36, thereby exiting said hull. If the boat should capsize and assume the turtle position, the selector valve is positioned to direct air pressure to the base of the mast. Activation of the pump delivers sufficient pneumatic pressure to the interior of said mast to drive water out of said mast through the downwardly positioned ejector means at the top of said mast. The increased buoyancy thereby created within the mast causes the boat to assume a sideways disposition which permits the crewman to return the boat to its upright position.

In a further mode of utilization of the apparatus of this invention, the check valves associated with the ejector means may be sealed in a manner to permit build-up of pressure within the hulls. Such pressurization will facilitate detection of fissures in the hull by observation of the emergence of bubbles, and will prevent entrance of water during sailing.

The optional flotation device 30 mounted adjacent the top of said mast may be additionally utilized in the righting operation by appropriate manipulation of valve 25.

While particular examples of the present invention have been shown and described, it is apparent that changes and modifications may be made therein without departing from the invention in its broadest aspects. The aim of the appended claims, therefore, is to cover all such changes and modifications as fall within the true spririt and scope of the invention.

Having thus described my invention, what is claimed is:

1. An improved system for removing water from the hollow interiors of the hulls and mast of a catamaran boat comprising:

a. a manually operable pneumatic pump releasibly attached to said boat, b. three flexible conduits, the proximal ends of which receive air from said pump, the distal ends of which are provided with disconnectable couplings, two of said distal ends communicating with the interiors of said hulls, and one of said distal ends communicating with the interior of said mast, and c. ejector means equipped with check valve means positioned in each of said hulls and said mast, whereby activation of said pump generates a pneumatic pressure which may be directed to the interiors of said hulls and mast to cause water therein to be driven out through said ejector means.

2. The system of claim 1 wherein said pump is releasibly attached to said boat by means which enable said pump to be operated while attached to said boat.

3. The system of claim 1 wherein said disconnectable couplings are insertively engageable quick-release connectors.

4. The system of claim 1 wherein said check valve means has provision for being sealed to cause build-up of pressure within said hull.

5. The system of claim 1 wherein said pump is capable of generating a pressure of at least ten pounds per square inch, and delivers at least 100 cc of air with a stroke length less than about ten inches.

6. The system of claim 1 wherein the air driven by said pump enters a selector valve to which the proximal ends of said conduits are attached.

* * * * *